US007244064B2

(12) United States Patent
Sullivan, Jr.

(10) Patent No.: US 7,244,064 B2
(45) Date of Patent: Jul. 17, 2007

(54) BAG WITH FLAP FOR BAG-IN-BOX CONTAINER SYSTEM

(75) Inventor: Joseph J. Sullivan, Jr., Cotuit, MA (US)

(73) Assignee: CDF Corporation, Plymouth, MA (US)

( * ) Notice: Subject to any disclaimer, the term of this patent is extended or adjusted under 35 U.S.C. 154(b) by 295 days.

(21) Appl. No.: 10/818,882

(22) Filed: Apr. 6, 2004

(65) Prior Publication Data

US 2005/0220369 A1 Oct. 6, 2005

(51) Int. Cl.

| | |
|---|---|
| ***B65D 33/14*** | (2006.01) |
| ***B65D 30/20*** | (2006.01) |
| ***B65D 33/16*** | (2006.01) |
| ***B65D 30/08*** | (2006.01) |

(52) U.S. Cl. ..... 383/22; 383/14; 383/66; 383/67; 383/111; 383/120; 383/906

(58) Field of Classification Search ..... 383/22, 383/14, 906, 120, 66, 67, 111

See application file for complete search history.

(56) References Cited

U.S. PATENT DOCUMENTS

| | | | | |
|---|---|---|---|---|
| 2,339,156 | A * | 1/1944 | Davis | 229/117.33 |
| 3,119,548 | A | 1/1964 | Cook et al. | |
| 3,447,732 | A * | 6/1969 | Deckys | 229/217 |
| 3,995,806 | A * | 12/1976 | McSherry | 229/248 |
| 4,596,040 | A | 6/1986 | LaFleur et al. | |
| 5,338,117 | A * | 8/1994 | Kucksdorf et al. | 383/9 |
| 5,618,254 | A | 4/1997 | Derby | |
| 5,765,723 | A | 6/1998 | Wilcox | |
| 5,788,121 | A | 8/1998 | Sasaki et al. | |
| 5,851,072 | A | 12/1998 | LaFleur | |
| 5,918,984 | A | 7/1999 | LaFleur et al. | |
| 6,120,181 | A | 9/2000 | Wilcox | |
| 6,139,482 | A | 10/2000 | Lafleur | |
| 6,371,646 | B1 | 4/2002 | LaFleur | |
| 6,378,733 | B1 * | 4/2002 | Boonzaier | 222/105 |
| 6,527,445 | B2 | 3/2003 | LaFleur et al. | |
| 6,644,510 | B2 | 11/2003 | Kawolics et al. | |
| 2005/0017011 | A1 * | 1/2005 | Andrews, Sr. | 220/495.06 |

* cited by examiner

*Primary Examiner*—Robin A. Hylton
(74) *Attorney, Agent, or Firm*—Pandiscio & Pandiscio

(57) ABSTRACT

A bag for storing material in liquid or particulate form, comprising four side walls and top and bottom walls that are integral extensions of the four side walls, is characterized by an additional single or multi-ply sheet that overlies and is sealed to one side of said bag, said sheet material being adapted to be partially separated from itself so as to form a flap at the top end of the bag that can be gripped for use in supporting the bag as it is being drained of its contents via a drain located at the bottom end of the bag.

26 Claims, 6 Drawing Sheets

BAG WITH FLAP FOR BAG-IN-BOX CONTAINER SYSTEM

FIELD OF INVENTION

This invention relates to flexible bags for use in bag-in-box container systems, and more particularly to means for facilitating removal of viscous or powdery materials from a bag in a box.

BACKGROUND OF THE INVENTION

In recent years a number of industries have adopted the bag-in-box concept for storing and transporting liquid and particulate commodities in relatively large quantities. For example, the bag-in-box has been employed for transporting in bulk such diverse products as vegetable oils, salad dressings, syrups, soy sauce, peanut butter, pharmaceuticals, talc, motor oil, industrial chemicals, detergents in liquid or powder form, and toiletry products or ingredients. The bag-in box concept comprises a flexible bag that is chemically resistant and impermeable to water and air and serves as the container for a selected commodity, and a box that serves as a protective container for the bag and its contents. By way of example, a bag used for shipping commodities in bulk typically may have a volume in the order of 60 cubic feet and include at least a drain fitting whereby its contents may be removed. Some bags are formed with a second fitting for use in filling the bag.

The outer box is provided with a discharge opening near or at its bottom end through which the liquid or particulate contents can be discharged from the bag via its drain fitting. That discharge opening may be fitted with another drain fitting that mates with or accommodates the drain fitting of the bag, whereby to assure that material discharged from the bag will be directed to the intended receiving facility and prevented from accumulating in the bottom of the box. Where the bags have two fittings, the filler fitting is usually located at or close to the top end of the bag. The protective box usually comprises a cover or top panel that is removable to permit access to the bag.

An important financial consideration of the bag-in-box mode of shipment of materials in bulk is that it can be a non-returnable or one-way container, in which case the box is generally made of a corrugated fiberboard or the like which can be discarded after use. Alternatively, the outer box may consist of interlocking panels of metal, wood or a stiff or rigid plastic material, in which case the box may be disassembled and returned to the shipper after the associated bag has been emptied of its contents.

Further with respect to the bag-in-box concept as applied to bulk shipment of commodities, the plastic bags have taken various forms, including the so-called "pillow" type which consists of two sheets of plastic film sealed together at their edges and four sided bags made from a plurality of sheets of plastic film, e.g., bags that take the shape of a cube or rectangular parallelepiped when filled. A specific form of four sided bag is disclosed in U.S. Pat. No. 5,788,121, issued Aug. 4, 1998 to H. Sasaki et al. Regardless of the type of bag in the box, if the bag is large, e.g., a bag having a volume of about 275 gallons, complete removal of all of the liquid or particulate material from the bag is difficult. The problem of removing all of the contents is noticeably difficult in the case of viscous liquids. Depending on the form of bag construction, complete emptying of the bag may be impeded by its size or shape, the location of its drain and/or the fact that as its contents are discharged, the evacuated portion of the bag tends to collapse.

Heretofore efforts have been made to provide means for supporting and tilting the plastic bags as they are being emptied via their drain fitting, so that the drain fitting is kept flooded with the viscous or particulate contents. One such effort is disclosed in U.S. Pat. No. 5,765,723, issued Jun. 16, 1998 to D. E. Wilcox. The Wilcox invention consists of a windlass that is mounted on the box and has a connector cord that is attached to a gathered portion of the bag by a noose. Operation of the windlass serves to lift and draw the gripped portion of the bag across the container toward the drain side of the container, and subsequently to wind the gripped portion of the container onto the windlass shaft. The result of the bag lifting and winding process is to move the viscous liquid material more effectively toward the drain.

However, a problem arises in using the Wilcox invention for emptying plastic bags that have a generally cubic or rectangular parallelepiped shape when filled, e.g., substantially self-supporting bags like those disclosed in U.S. Pat. No. 5,788,121, cited supra, since those bags are difficult to grasp with a noose. One proposed solution was to make a cube-shaped or rectangular parallelepiped bag by providing a plastic tube having a square or rectangular cross-sectional configuration and attaching top and bottom panels of like plastic material to the opposite ends of the tube by means of heat seals, with the bottom wall panel conforming in shape and size to the bottom end of the tube and the top end panel differing from the bottom panel in that at one side it projects laterally outward of one side of the rectangular tube so as to provide a tab portion that can be grasped to support the bag as it is being emptied via a drain provided at the bottom end of the tube. The tab portion is long enough to be wrapped on itself around the windlass shaft, whereupon further rotation of the windlass shaft produces a lifting force on the bag that results in the bag's contents being urged toward the drain by gravity.

Unfortunately the structural integrity of the foregoing tab construction is limited by the strength of the seal made by the end panels with the ends of the tube. Those seals are narrow and when the tab is wound on the windlass shaft, the weight of the bag and its contents tend to stress the top end panel to the extent that it may tear or separate where it is joined to the tube. That method of making a bag with a flap is labor intensive and hence costly.

Accordingly it is desirable to provide a new and improved tab construction that is characterized by a structural integrity sufficient to support the weight of a bag and its contents as it is being wound on a windlass.

OBJECTS AND SUMMARY OF INVENTION

The primary object of this invention is to provide a bulk storage bag of the kind having a drain with an improved form of tab for use in supporting the bag so as to facilitate complete emptying of its contents via the drain.

Another object is to provide a bulk storage bag for a bag-in-box application that is provided adjacent its top end with an improved tab for use in supporting the bag as its contents are emptied via a drain located at or adjacent to its bottom end.

A further object is to provide a bag for storing a liquid or powdery material that is formed from several portions of single or multi-ply sheet material and comprises a tab for use in supporting the bag as its contents are emptied via a drain, characterized in that the tab is formed by an additional portion of single or multi-ply sheet material that is secured to and extends parallel to one of those several portions.

Still another object is to provide a bag, formed of flexible single or multi-ply sheet material having the general shape of a rectangular parallelepiped when filled, with a tab that can be used to support the bag as it is emptied of its content via a drain located at or adjacent its bottom end.

A more specific object is to provide a bag that is formed by sealing together portions of single or multi-ply sheet material with one of those portions including a drain device for emptying the bag of its fluid contents and another of those portions being adapted to form a tab for supporting the bag when it is being emptied of its contents.

In a preferred embodiment of the invention, these and other objects that are rendered apparent by the following detailed description are achieved by sealing together five portions of single or multi-ply sheet material, with four of those portions forming a bag of generally cubic shape and one of those four portion including a drain device for emptying the bag of its fluid contents, and the fifth portion of single or multi-ply material overlying one of the other four portions and being adapted to form a tab for supporting the bag when it is being emptied of its contents. A like flap construction can be provided for bags made from tubular webs. Other details and features of the bag and tab construction are disclosed or rendered obvious by the following detailed description and the accompanying drawings.

THE DRAWINGS

In the several figures like numerals designate like elements.

DETAILED DESCRIPTION OF THE INVENTION

The preferred embodiment of the invention is a four side-seal type bag 2 composed of five discrete portions or panels 4, 6, 8, 10 and 12 of flexible, heat-sealable packaging material in sheet form. The packaging material is impervious to water and also preferably to oils and other liquid materials. By way of example but not limitation, the packaging sheet material may consist of polyethylene or polypropylene or some other thermoplastic material or be a laminate of two or more packaging materials bonded to one another. Each of the portions or panels 4-12 may comprise a single sheet of packaging material ("single ply") or two or more sheets of packaging material ("multi-ply"). In the case of multi-ply portions, the individual sheets ("plies") may be of like or different material and, as is rendered obvious by the following detailed description, they are secured to one another only in selected areas. The preferred embodiment is a two-ply bag. For convenience and simplicity of illustration, the two-ply construction is evidenced only in FIGS. 3 and 4, with the two plies of portion 4, for example, being identified as 4A and 4B. However, in the following description, it is to be assumed and understood that each of the five discrete portions 4-12 of the bag consists of two plies of flexible packaging material.

Figure 1:
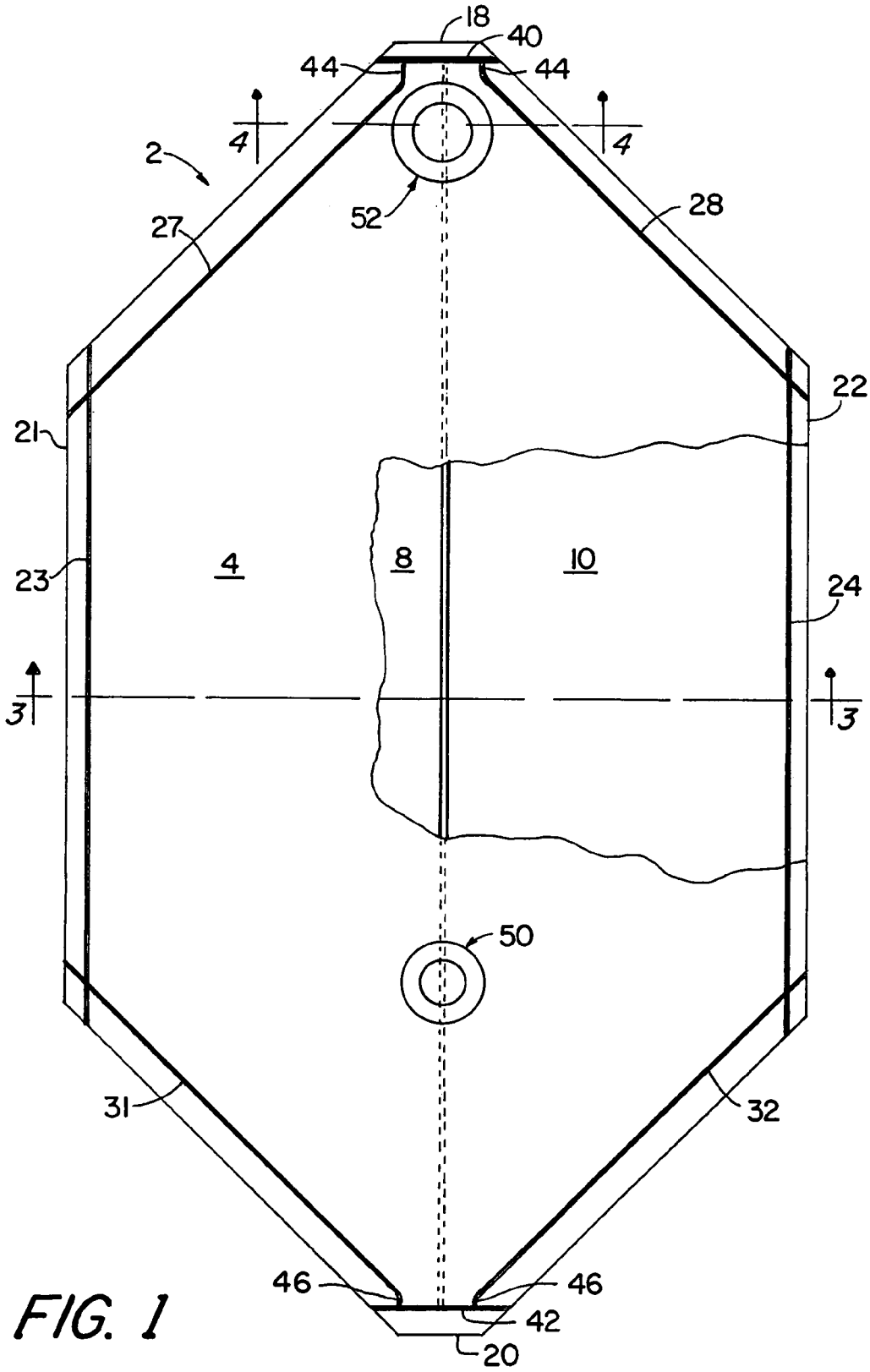
FIG. 1 is a plan view of a bag constituting a preferred embodiment of the invention in a flattened as-made condition, with a part of the bag broken away.
Figure 2:
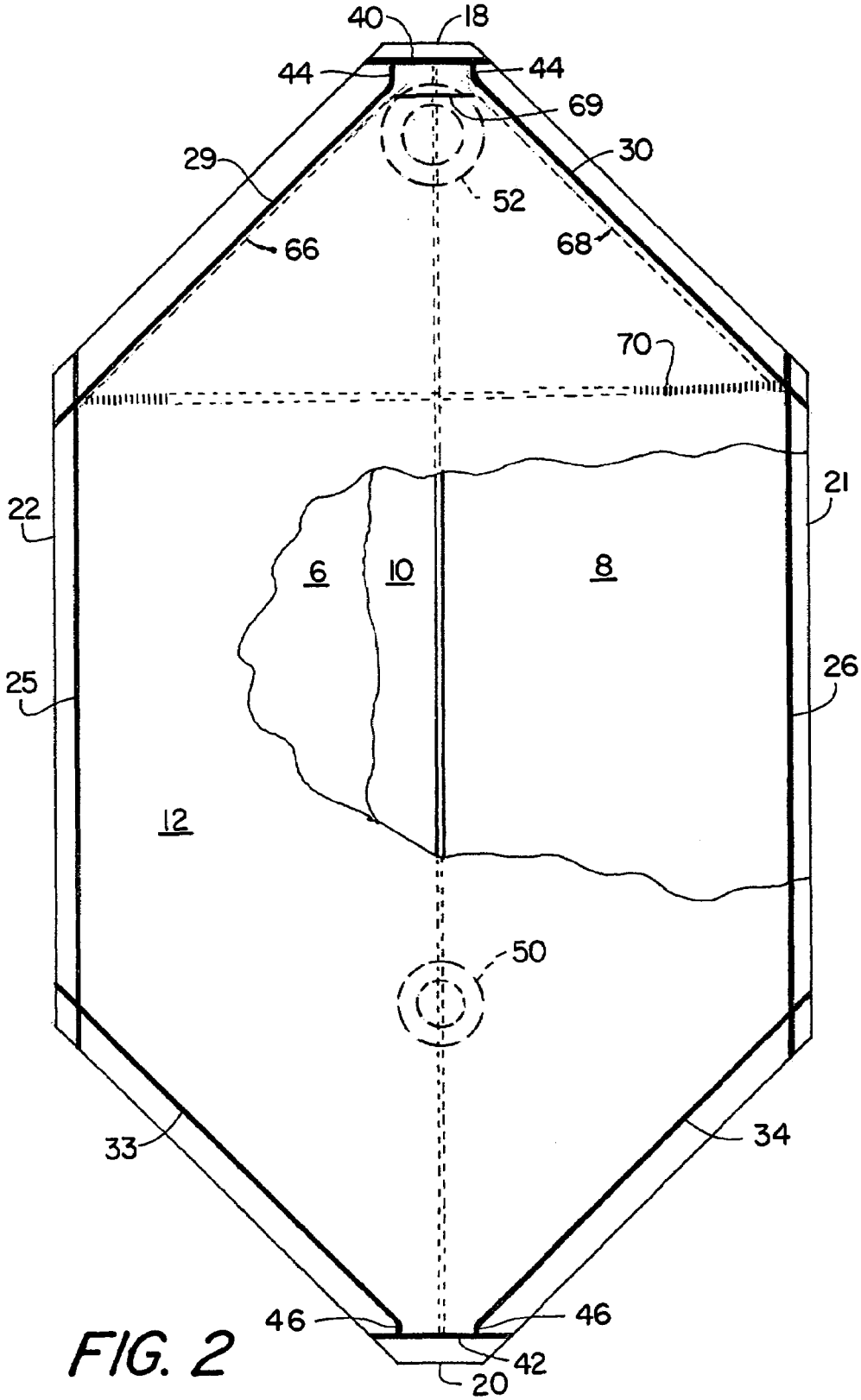
FIG. 2 is a bottom view of the same bag in its flattened as-made condition, with parts broken away.
Figure 3:
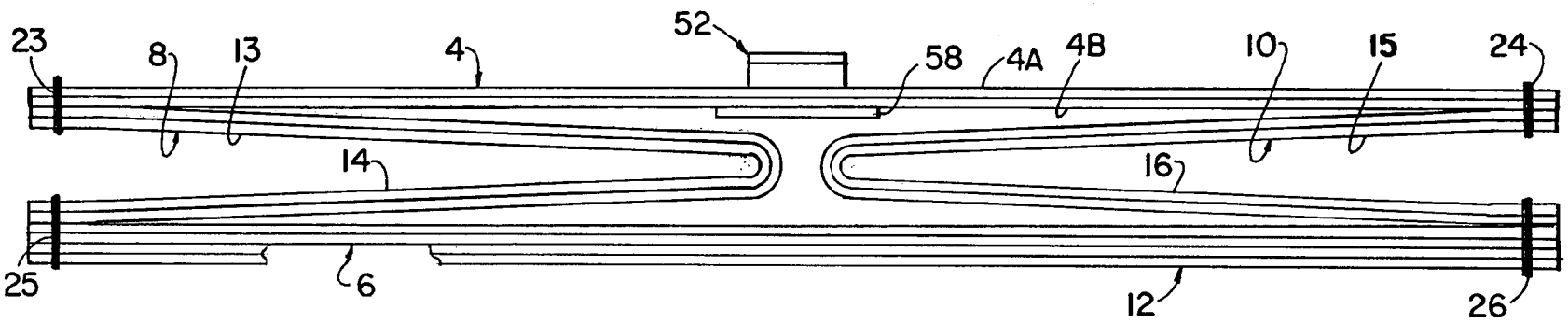
FIG. 3 is a cross sectional view taken along line 3-3 of FIG. 1, with one of the bag portions broken away.

Referring to FIGS. 1-3 (which show the bag in its flat as-formed condition), the portions 4 and 6 are opposed to one another, the portions 8 and 10 are interposed between them, and the portion 12 covers and is coextensive with portion 6. The portions 8 and 10 are folded on themselves to form gussets consisting of folds 13, 14 and 15, 16 respectively. Portions 4, 6 and 12 have a generally hexagonal edge configuration, except for being truncated as shown at 18 and 20. In this connection it is to be appreciated that the portions 4-12 are cut from parallel elongate supply webs of packaging material, with the portions 4, 6 and 12 having substantially the same width, i.e., the distance between their opposite side edges 21 and 22, as the webs from which they are separated, and with the portions 8 and 10 being folded and inserted between portions 4 and 6 before the portions 4-12 were cut from the supply webs. As used herein and where the context so admits, the term "sheet web" is to be understood as consisting of a single continuous sheet or two or more continuous sheets ("plies") that are brought together to form a multi-ply portion of a bag.

The portion 4 is sealed along its two longitudinally extending side edges to the adjacent side edges of folds 13 and 15 of portions 8 and 10 respectively, as represented by seal lines 23 and 24 (FIGS. 1 and 3), and the portion 6 is sealed along its two longitudinally extending side edges to the adjacent side edges of folds 14 and 16 of portions 8 and 10, as represented by seal lines 25 and 26 (FIGS. 2 and 3). Adjacent one end of the bag two oblique seals 27, 28 secure the portion 4 to folds 13 and 15 and two like oblique seals 29, 30 (FIG. 2) secure the portion 6 to folds 14 and 16. Adjacent the opposite end of the bag two oblique seals 31, 32 secure the portion 4 to folds 13 and 15 and two like oblique seals 33, 34 secure the portions 6 and 12 to folds 14 and 16. The oblique seals 27, 28, 31 and 32 extend to and intersect the longitudinal seals 23 and 24, while the other like oblique seals 29, 30, 33 and 34 extend to and intersect the other longitudinal seals 25 and 26.

At the top end of the bag the five portions 4-12 are sealed together by a cross seal 40 that extends to and intersects the seals 27-30. At the opposite end of the bag the five portions 4-12 are secured together by a cross-seal 42 that extends to and intersects seals 31-34. Preferably the eight oblique seals have angular extensions as shown at 44 and 46 that extend to and intersect the cross seals 40 and 42.

Figure 4:
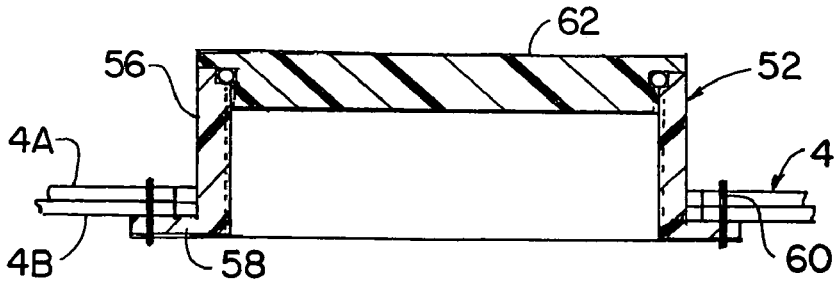
FIG. 4 is a cross sectional view of one portion of the bag taken along line 4-4 of FIG. 1.

The portion 4 is formed with two openings, and mounted in those openings are two like tubular fitments 50 and 52. Fitment 50 is intended to function as a drain and is located equidistant from the two longitudinal side edges of bag portion 4 at a point that is almost even with the intersections of oblique seals 31 and 32 with longitudinal seals 23 ands 24 respectively. Fitment 52 is for filling purposes and is located close to the junctions of cross seal 40 with oblique seals 27 and 28. Referring to FIG. 4, the fitment 52 comprises two parts, a fixed tubular part 56 having a flange 58 that underlies and is sealed to portion 4 by a circular seal 60 and a cap 62 that is releasably attached to and closes off tubular part 56.

Cap 60 may be attached to tubular part 56 by a screw, bayonet, snap-fit or other suitable form of connection.

Figure 5:
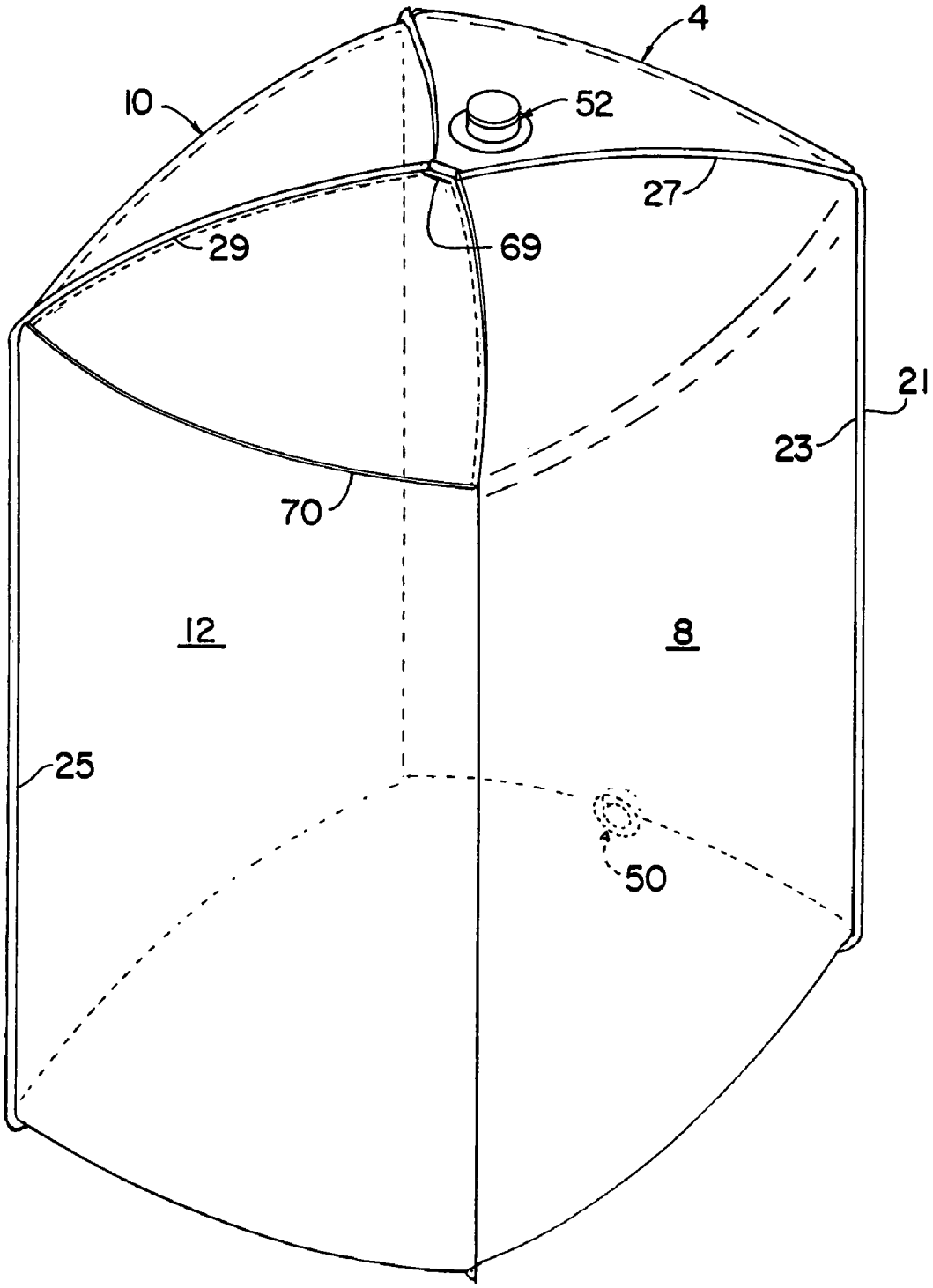
FIG. 5 is a perspective view showing the bag in its inflated or filled state.

Referring now to FIGS. 2 and 5, the fifth discrete portion 12 has a transverse slit 69 located a short distance from cross-seal 40, and two lines of perforations, represented by dotted lines 66 and 68, that commence near slit 69 and extend inboard of and parallel to the oblique seals 29 and 30 respectively. The two lines of perforations 66 and 68 terminate near the junctions of oblique seals 29 and 30 with longitudinal seals 25 and 26 respectively. Additionally portion 12 is sealed to portion 6 by a cross-seal 70 which preferably constitutes a series of short, narrow, parallel line seals as represented by the parallel lines in FIG. 2. Preferably cross-seal 70 is located so that it extends to the junction of side seals 25 and 26 with oblique seals 29 and 30.

Figure 6:
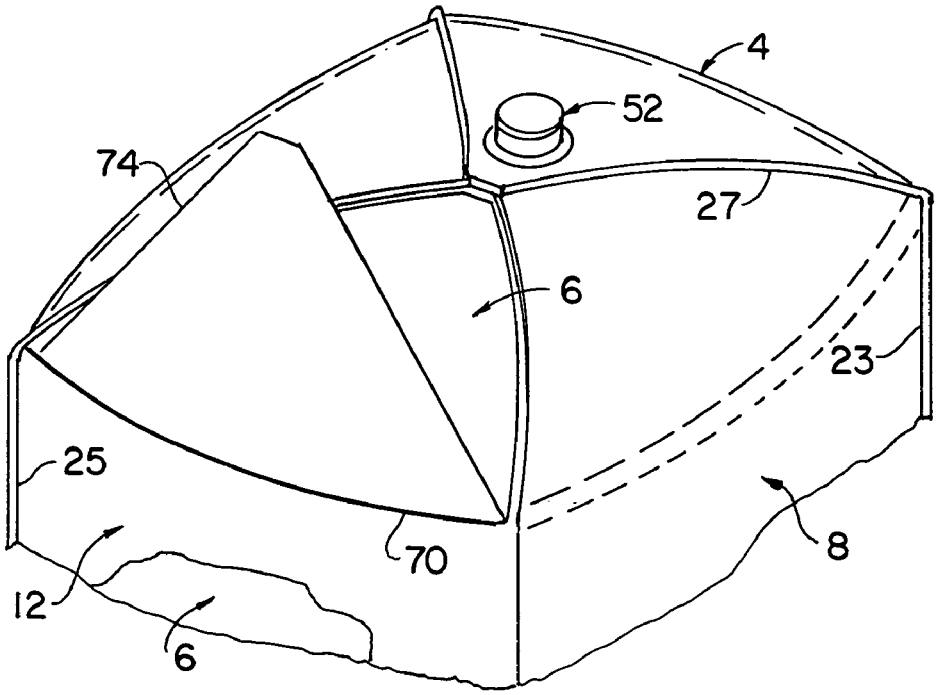
FIG. 6 illustrates how the flap is formed from a single or multi-ply sheet attached to the bag.

Referring now to FIGS. 5 and 6, the above-described bag assumes the general shape of a cube or a rectangular parallelepiped when is inflated, with the portions 8 and 10 unfolding to eliminate the gussets. Assuming for sake of description that the drain fitting 50 is on the front side of the bag, the portions 4 and 6 form the front and rear walls of the bag and the portions 8 and 10 form the opposite side walls. Because of the arrangement of the oblique seals in relation to the longitudinal seals 21-24 and cross seals 40 and 42, the portions 4, 6, 8 and 10 come together to form the top and bottom walls of the bag, with the filler fitment 52 located at the top of the bag and the drain fitment 50 located at the bottom and on the front side of the bag. Since it is edge-sealed to portion 6, when the bag is inflated the portion 12 follows the contour of portion 6 at the top end of the bag.

The inflated or filled bag is self-supporting in the sense that it tends to remain erect and not fall over when its bottom end is resting on a flat floor or platform. When the uninflated bag is inserted in a box for a bag-in-box application, the flexibility of the bag allows the drain fitment to be properly positioned in any commodity discharge opening provided in the bottom of the box. Positioning the drain fitting in the discharge opening of the box assures ready access to its cap 62 from outside of the box after the bag has been filled, which is important since removal of the cap of the drain fitment is required to initiate the bag-emptying process.

Because of the flexibility of the portions 4-12 of packaging material, when the bag is being emptied of its contents via drain 50, the upper portion of the bag tends to collapse, making it difficult to completely empty the bag of viscous contents such as peanut butter, industrial oil or the like and making it desirable to have a flap that can be grasped to support the bag. To provide a flap, the operator need only grasp the edge of portion 12 at the slit 69 and exert a pulling force down away from the top of the bag, whereupon the portion 12 will tear along the two lines of perforations 66 and 68. The tearing action stops at the cross seal 70, resulting in a generally triangular flap 74 as shown in FIG. 6. This flap can then be grasped or attached to a suitable mechanism for supporting the bag, e.g., wound on a rotatable roller or mandrel of a winch or windlass. The winch or windlass mechanism may be supported by the box that contains the filled bag, in the manner disclosed by Wilcox in U.S. Pat. No. 5,765,727, cited supra, or it may be a free-standing apparatus.

Because the cross seal is on the back side of the bag and diagonally opposite to the location of the drain fitment 50, exerting a vertical pulling force on flap 74 has the effect of raising the back side of the bag and providing a tilting effect that causes the drain to remain flooded with the contents of the bag until the bag is substantially completely empty. Because the flap is an integral part of portion 12 which is sealed along its edges and also along seal 70 to portion 6, its strength is more than adequate to support the weight of the bag and its contents as the bag is being emptied. The remainder of portion 12 also serves to reinforce the side of the bag formed by portion 6. It is to be noted that where the bag is supported by winding flap 74 on a roller or mandrel of a winch or windless apparatus, after emptying has started, the winding may be extended to flatten and wind up the newly emptied upper portion of the bag, thereby helping to promote complete discharge of the bag's contents.

As indicated hereinabove, the portions 4-10 that make up the bag and the portion 12 that is used to provide the flap 74 may consist of a single ply or two or more plies. In the case of two or more plies, it is to be understood that the plies are separate from one another except in the areas of the seals described above, and that each ply may consist of a single plastic film or be a laminate of two or more materials. Also it is contemplated that the portions 4-10 may be multi-ply while the portion 12 is a single ply, in which case the portion 12 may be of a heavier gauge, i.e., thicker, than the portions 4-10 in order to assure that it will have the tensile strength required to support the load of a bag and its contents.

Figure 7:
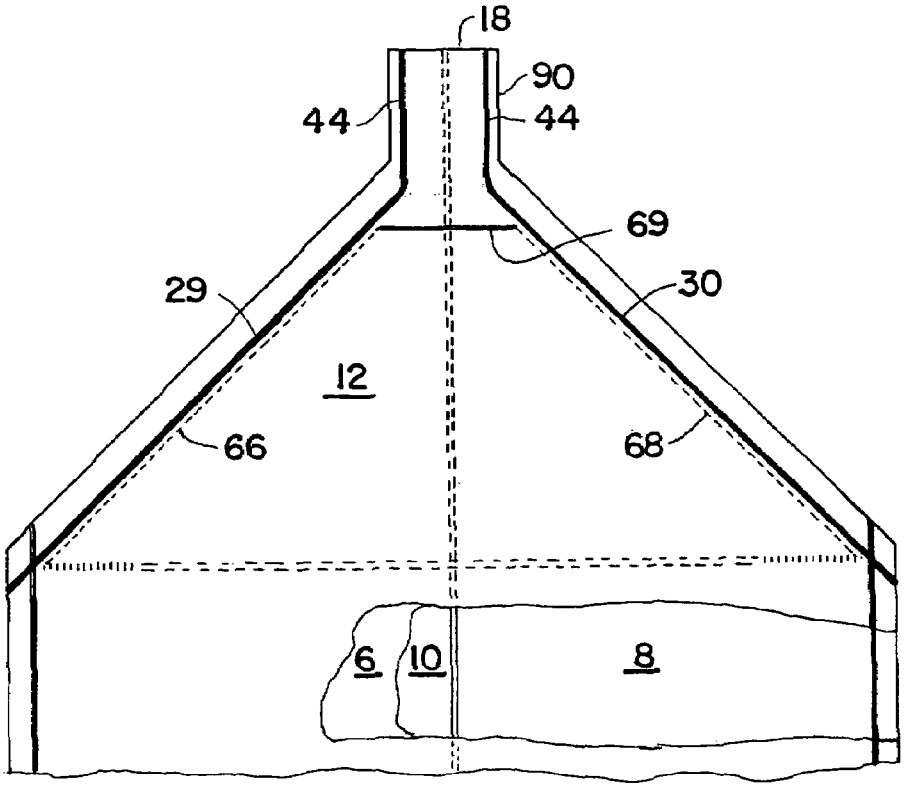
FIG. 7 is a fragmentary view, taken from the same viewpoint as FIG. 2, of an alternative embodiment of the invention.
Figure 8:
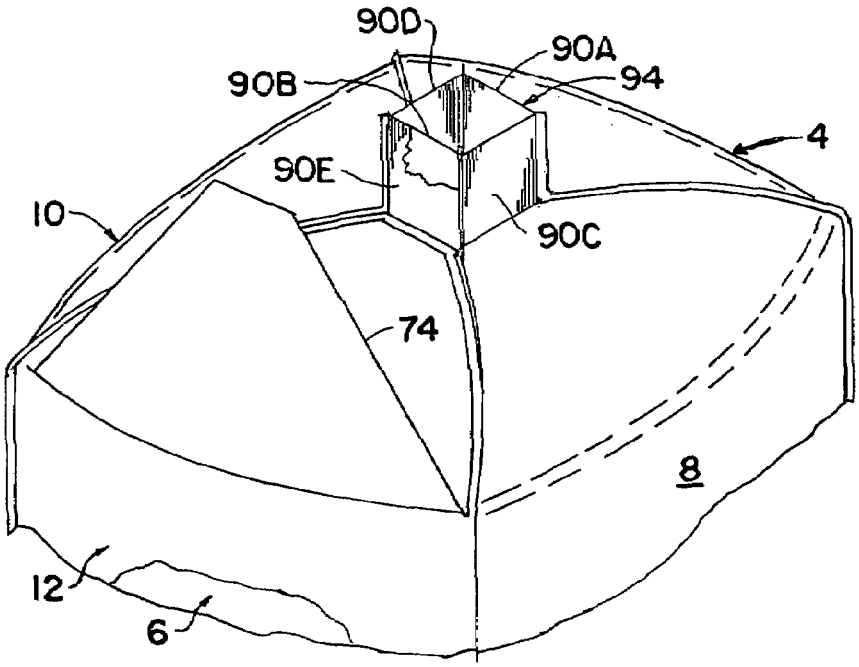
FIG. 8 is a view like FIG. 6 of the same alternative embodiment.

FIGS. 7 and 8 illustrate an alternative embodiment of the invention. Like the preferred embodiment, its several portions 4-12 may consist of a single ply or two or more plies as described above. In this alternative embodiment, the filler fitment 52 is omitted from portion 4 (as is also the hole for fitment 52), and at the end of the bag characterized by oblique seals 27-30 the several sheet portions 4-12 are modified by extending them so as to form neck sections identified collectively by the numeral 90 in FIG. 7. The seal sections 44 are correspondingly extended to the end edges 18 of neck sections 90. However, at the top end edges 18 the several sheet portions are not sealed together by a cross-seal. The back sheet portion 12 is unchanged in that it includes slit 69 whereby it can be torn away along the perforated lines 66 and 68.

Referring to FIG. 8, when the bag is inflated the neck sections 90 of the several sheet portions 4-12 form a spout 94 with a substantially square cross-sectional configuration that can be used for filling the bag with a selected liquid or particulate commodity. In FIG. 8 the neck sections 90 of the sheet portions 4, 6, 8, 10 and 12 are specifically identified as 90A, 90B, 90C, 90D and 90E respectively. After the bag has been filled, spout 94 can be sealed shut by securing together the four sections 90A-E, e.g., by an adhesive, stitching, or stapling, or by adding a closure member (not shown) that fits over or inside of the spout and sealing it to the spout.

The alternative embodiment shown in FIGS. 7 and 8 may be preferred for certain applications where it is customary to employ bags or liners with spouts, e.g. the applications contemplated for bags and liners disclosed in U.S. Pat. No. 6,371,646, issued Apr. 16, 2002 to L. LaFleur, and U.S. Pat. No. 4,596,040, issued Jun. 17, 1986 to A. E. Lafleur et al. This alternative embodiment also offers the advantage that it can be made by the same apparatus used to produce the preferred embodiment of FIGS. 1-6, with only minor changes being required to adapt that apparatus for the manufacture of the alternative embodiment.

The invention is susceptible of other modifications. For example, the two lines of perforations 66 and 68 may be formed as a single line curved in an arc, with the apex of the arc being tangent or close to the slit 69. The fitments 50 and 52 may have different structures as, for example, the form of fitment disclosed by U.S. Pat. No. 5,851,072, issued Dec. 22, 1998 to L. LaFleur. The drain fitment may be adapted for attachment thereto of a faucet or discharge valve or a flexible hose line for use in directing the discharged commodity to a desired storage or use facility. Also, the filler fitment 52 may be omitted, in which case drain fitment 50 may also serve as a filler means for the bag.

In the construction shown in FIGS. 1 to 8, the portions 8 and 10 have substantially the same width when unfolded as portions 4 and 6, whereby the inflated bag has a substantially cubic shape. However, the bag also may be formed so that the portions 8 and 10 have smaller widths when unfolded than portions 4 and 6, whereby the bag will have a rectangular parallelepiped shape when inflated. Although the seals whereby the portions 4-12 are connected together are illustrated by single lines, it is to be understood that the cross-seals and the longitudinal and oblique seals that connect portions 4 and 6 to portions 8 and 10 and portion 12 to portion 6 may vary in width and, for example, may extend out to the edges of portions 4-12. Also slit 69 may be replaced by a line of perforations between perforation lines 66 and 68 to help prevent accidental tearing out of flap 74. Seal 70 also may be modified in form, shape and location. By way of example but not limitation, it can be formed as an uninterrupted straight or curved line seal of suitable width and moved closer to or further from the end edge 18. Also the length of seal 70 may be adjusted so that it will intersect or terminate close to perforations 66 and 68, or oblique seals 29 and 30 or side seals 25 and 26. It is to be noted also that the bag shown in FIGS. 1-8 may be modified by eliminating the cross-seals 40 and 42 and having the oblique seals 27 and 28, 29 and 30, 31 and 32, and 33 and 34 intersect one another, in the manner of the bottom diagonal seals 102 shown in FIG. 16 of U.S. Pat. No. 4,596,040, issued Jun. 17, 1986 to A. E. Lafleur et al, and the seals C in FIG. 1 of U.S. Pat. No. 3,119,548, issued Jan. 28, 1965 to S. Cook et al. A further possible modification is to modify the oblique heat seals at one or both ends of the bag so that they curve inwardly, in the manner suggested by FIGS. 9 and 10 of Cook et al.

The invention also may be practiced with bags of different constructions having drain fitments at their bottom ends. For example, the four side seal bag shown in FIGS. 1 and 2 of U.S. Pat. No. 5,788,121, issued Aug. 4, 1998 to H. Sasaki et al., may be modified by the addition of another portion of flexible packaging sheet material that is perforated to form a flap like flap 74. More specifically, the spout 12 shown in FIGS. 1 and 2 of Sasaki et al. would be moved to the bottom end of the bag and a portion of packaging sheet material corresponding to portion 12 of the bag shown in FIGS. 1 to 8 hereof would be added to the side of the bag that is opposite to the spout.

Furthermore, although the preferred embodiment of the invention comprises a bag formed from portions of four sheet webs connected by four longitudinal seals, the invention also may be incorporated in bags made using tubular webs. Thus, by way of example but not limitation, the present invention may be embodied in bags constructed in accordance with the teachings of U.S. Pat. No. 6,527,445, issued Mar. 4, 2003 to L. LaFleur et al.; U.S. Pat. No. 6,371,646, issued Apr. 16, 2002 to L. LaFleur; U.S. Pat. No. 6,139,482, issued Oct. 31, 2000 to L LaFleur; U.S. Pat. No. 5,918,984, issued Jul. 6, 1999 to L. LaFleur et al; and U.S. Pat. No. 5,618,254, issued Apr. 8, 1997 to N. C. Derby. The teachings of the foregoing patents are incorporated herein by reference. For purposes of utilizing the present invention, bags having the constructions described and illustrated in the aforesaid patents would be provided with a drain fitment located as shown in FIGS. 1 and 5 hereof and also modified by addition of a sheet portion corresponding to the sheet potion 12 herein described and illustrated, with the additional sheet portion being adapted to provide a flap like flap 74. As with the embodiment shown in FIGS. 1-8, the additional sheet portion would be attached to a side of the bag that is opposite to the side having the drain fitment.

It is to be noted also that two-ply bags may be made by inserting a first tubular web inside of a second tube web, folding the two webs inward to provide a pair of opposite side gussets (e.g., as shown in U.S. Pat. No. 6,527,445 (FIGS. 4 and 5), U.S. Pat. No. 5,918,984 (FIG. 4) and U.S. Pat. No. 5,618,254 (FIG. 2), and then sealing the webs lengthwise and also with cross-seals and or oblique seals (in accordance with the teachings of the foregoing specification or the aforementioned patents) to form a bag of cubic or rectangular parallelepiped shape. Alternatively the gussets may be formed in the two tubular webs before they are inserted inside one another. Drain fitments would be attached to the tubular webs. Incorporating the present invention in two ply bags made from two tubular webs, one inside of the other, is achieved by attaching an extra single or multi-ply sheet corresponding to sheet portion 12 to the outer tubular web on one of the four sides of the uninflated bag, with the flap corresponding to flap 74 being located at the top end of the bag diagonally opposite to the drain fitment. Alternatively a third tubular web of like cross-sectional shape could be slipped over and attached to the first two webs, with the third tubular web being adapted along one side of the bag to provide a flap corresponding to flap 74.

In addition to proving a strong and readily usable flap, the present invention offers the advantage that it may be incorporated in bags of different sizes and is not limited to bag-in-box applications. A further advantage is that existing bag-making machines, particularly those of the type designed to make a series of four-side-seal bags using four webs of flexible packaging material or those designed to make bags using two or more tubular webs, are easily modified to manufacture bags incorporating the present invention, such modification requiring merely the capability of introducing an additional web of packaging material into the bag-making process for use in forming the portion 12 described above. In comparison to the prior method of forming a bag with a flap as previously described, bags incorporating the present invention can be made more rapidly and at lower cost. Other modifications and advantages will be obvious to persons skilled in the art from the foregoing description.

What is claimed is:

1. A bag for storing material in liquid or particulate form comprising four single or multi-ply individual portions of flexible heat-sealable material in sheet form that are sealed to one another and a fitting in a first one of said portions for providing access to the interior of said bag, characterized by the addition of a fifth single or multi-ply individual portion that overlies and is coextensive with a second one of said four single or multi-ply portions, said fifth portion being secured to said second one of said four single or multi-ply portions, said additional fifth portion being perforated in a selected area so as to allow a predetermined part thereof to be partially separated from said additional fifth portion in the form of a tab that can be gripped for use in supporting the bag as it is being drained of its contents via said fitting.

2. A bag according to claim 1 further including a second fitting mounted in an opening in said first one of said four single or multi-ply portions.

3. A bag according to claim 1 wherein said four portions are shaped to form a spout at one end of the bag.

4. A folded bag constructed of four individual portions of flexible sheet material that is adapted to unfold into an inflated state, with said four portions of flexible sheet material coacting when said bag is in said inflated state to form four side walls and closed top and bottom ends of the bag, characterized by a drain fitting mounted in an opening in a first one of said four portions of flexible sheet material at the bottom end of the bag and further including a fifth individual portion of flexible sheet material overlying and attached at its side edges to adjacent side edges of a second one of said four portions of flexible sheet material, said fifth portion of flexible sheet material comprising a series of perforations demarcating a tear pattern whereby to allow a predetermined section of said fifth portion to be partially separated therefrom so as to form a flap that may be grasped for lifting the bag.

5. A folded bag according to claim 4 wherein said drain fitting is on one side of the bag and further wherein said predetermined section is located at the top end of the bag.

6. A folded bag according to claim 4 wherein said perforations form a non-straight line pattern extending between and to the side edges of said fifth portion of flexible sheet material, whereby when said predetermined section is partially separated from said fifth portion to form said flap, said flap will extend across substantially the full width of said fifth portion.

7. A folded bag according to claim 4 wherein said fifth portion of flexible sheet material is attached to said second portion of flexible sheet material by a cross-seal that extends between the side edges of said fifth and second portions of flexible sheet material and limits separation of said predetermined section from said fifth portion.

8. A bag according to claim 4 wherein said four individual portions of flexible sheet material all have the general shape of a hexagon that is truncated at two opposite corners.

9. A bag according to claim 4 wherein said four individual portions of flexible sheet material are shaped so as to form a pouring spout when the bag is inflated.

10. A bag formed of first, second, third and fourth discrete portions of a flexible heat-sealable packaging material, with said first and second portions opposing one another and said third and fourth portions opposing one another and disposed between said first and second portions, a fifth portion overlying said second portion, each of said portions having a first end and a second end and a pair of opposite side edges extending between said first and second ends, with said first portion being sealed at its opposite side edges to side edges of said third and fourth portions and said second and fifth portions being sealed at their side edges to other side edges of said third and fourth portions, said third and fourth portions each being folded inward along a fold line that extends parallel to and is spaced from the side edges of said third and fourth portions;

a filler fitment and a drain fitment attached to mutually spaced openings in said first portion for use in introducing a commodity to and removing that commodity from the bag;

a first pair of mutually converging seals connecting said first portion to said third and fourth portions adjacent said first ends of said portions, a second pair of mutually converging seals connecting said second and fifth portions to said third and fourth portions adjacent said first ends of said portions;

a third pair of mutually converging seals connecting said first portion to said third and fourth portions adjacent said second ends of said portions, a fourth pair of mutually converging seals connecting said second and fifth portions to said third and fourth portions adjacent second ends of said portions;

a first cross-seal connecting all of said portions to one another adjacent said first and second pairs of mutually converging seals, said first and second pairs of mutually converging seals being located between said first cross-seal and said third and fourth pairs of mutually converging seals, and a second cross-seal connecting said all of said portions to one another adjacent said third and fourth pairs of mutually converging seals, said third and fourth pairs of mutually-converging seals being located between said second cross-seal and said first and second pairs of mutually converging seals, whereby when said bag is inflated by unfolding said third and fourth portions the bag will have the general shape of a cube or a rectangular parallelepiped;

characterized in that said fifth portion has a series of perforations demarcating a tear line whereby a section of said fifth portion is partially separable from said fifth portion so as to form a flap that can extend outwardly from said second portion in position to be grasped to elevate the bag to facilitate complete emptying of its contents via its drain fitment.

11. A bag according to claim 10 wherein at least said first, second, third and fourth portions are multi-ply.

12. A bag comprising first, second, third and fourth discrete sheets of single or multi-ply flexible packaging material sealed together so that the bag is characterized by four side walls, a top end and a bottom end formed by said first, second, third and fourth sheets, a drain in one of said side walls adjacent said bottom end, and a fifth sheet of flexible material overlying and coextensive with said second sheet and having edge areas thereof attached to edge areas of said second sheet, with said fifth sheet being perforated adjacent said top end of the bag so that a section thereof can be torn to form a flap that can be grasped to lift said bag to facilitate removal of contents from the bag.

13. A bag according to claim 12 further including a filler fitting in one of said four sheets at said top end of said bag.

14. A bag according to claim 12 wherein said section of said fifth sheet is located at the top end of the bag at a side of the bag opposite to the side wall in which the drain is located.

15. A bag according to claim 12 wherein said fifth sheet has two lines of perforations and a slit extending between adjacent ends of said two lines of perforations.

16. A bag according to claim 15 wherein said fifth sheet is attached to said second sheet by a cross-seal, and further wherein said two lines of perforations extend from said cross seal to said slit.

17. A bag according to claim 12 wherein said fifth sheet consists of two or more plies.

18. A bag comprising four rectangular side walls and top and bottom walls that are integral extensions of the side walls, and a sheet material attached to said bag, said sheet material overlying and sealed to one of said side walls and sections of said top and bottom walls, said sheet material having a line of perforations overlying said section of said top wall with said perforations disposed so as to allow a portion of said sheet material to be partially separated therefrom so as to form a flap at the top end of the bag that can be gripped for use in supporting the bag.

19. A bag comprising four rectangular side walls and top and bottom walls that are integral extensions of the side walls, said walls all being made of a flexible packaging material, and a sheet material attached to said bag, said bag when collapsed comprising a pair of flat overlying panels and a pair of folded gusset panels extending inwardly between the pair of flat overlying panels, a first pair of mutually-converging diagonal seals adjacent one end of each flat panel connecting that flat panel to the adjacent fold of each folded gusset panel; a second pair of additional mutually-converging diagonal seals adjacent the opposite end of each flat panel connecting that flat panel to the adjacent fold of each folded gusset panel, the two diagonal seals of each pair of mutually-converging diagonal seals terminating in inner ends that are in spaced relation to each other inwardly of the opposite side edges of the flat panels, and cross-seals extending between the inner ends of each pair of diagonal seals and connecting each flat panel to the adjacent fold of each folded gusset panel, said sheet material overlying a first one of said flat panels and being attached to said one flat panel by additional seals aligned with said first and second pairs of mutually-converging diagonal seals, and said sheet material having a line of perforations overlying said top wall and arranged so as to allow a portion of said sheet material to be partially separated therefrom to form a flap that can be gripped for use in supporting the bag.

20. A bag according to claim 19 including a drain fitment installed in an opening in a second one of said flat overlying panels, said drain fitment being located at the bottom end of the bag when the bag is inflated.

21. A bag according to claim 19 wherein said perforations are located adjacent one end of said sheet material.

22. A bag according to claim 18 wherein each of said side walls and said top and bottom walls comprise two or more plies of flexible sheet material.

23. A bag according to claim 4 wherein said perforations are located adjacent one end of said fifth portion of flexible sheet material.

24. A bag according to claim 12 wherein said fifth sheet is attached to said second sheet by side seals extending along opposite side edges of said second and fifth sheets and also by a transverse seal that extends between said opposite side edges, with said transverse seal being located at said top end of said bag.

25. A bag according to claim 12 wherein said section of said fifth portion is demarcated by two lines of perforations that extend away from said transverse seal.

26. A bag according to claim 10 comprising a third cross-seal securing said fifth portion to said second portion, said third cross-seal being spaced from said first cross-seal with said first pair of mutually converging seals extending between said first and third cross-seals, and further wherein said series of perforations extend from adjacent said third cross-seal to adjacent said first cross-seal, whereby said section of said fifth portion is bounded by said first pair of converging seals and said first and third cross-seals.

* * * * *